US010845087B2

(12) United States Patent
Koda et al.

(10) Patent No.: US 10,845,087 B2
(45) Date of Patent: Nov. 24, 2020

(54) AIR-CONDITIONING APPARATUS

(71) Applicant: Mitsubishi Electric Corporation, Tokyo (JP)

(72) Inventors: Misaki Koda, Tokyo (JP); Yutaka Aoyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/307,387

(22) PCT Filed: Aug. 22, 2016

(86) PCT No.: PCT/JP2016/074373
§ 371 (c)(1),
(2) Date: Dec. 5, 2018

(87) PCT Pub. No.: WO2018/037452
PCT Pub. Date: Mar. 1, 2018

(65) Prior Publication Data
US 2019/0309984 A1 Oct. 10, 2019

(51) Int. Cl.
*F24F 13/22* (2006.01)
*F24F 1/18* (2011.01)
*F24F 1/36* (2011.01)

(52) U.S. Cl.
CPC ..... *F24F 13/222* (2013.01); *F24F 1/18* (2013.01); *F24F 1/36* (2013.01)

(58) Field of Classification Search
CPC ... F24F 13/222; F24F 1/36; F24F 1/18; F25D 21/14
See application file for complete search history.

(56) References Cited

U.S. PATENT DOCUMENTS 5,966,959 A 10/1999 Stewart
2011/0154845 A1 6/2011 Ashida
(Continued)

FOREIGN PATENT DOCUMENTS

CN 102187158 A 9/2011
CN 203274200 U 11/2013
(Continued)

OTHER PUBLICATIONS

Office Action dated Nov. 26, 2019 issued in corresponding JP patent application No. 2018-535937 (and English translation).
(Continued)

*Primary Examiner* — Emmanuel E Duke
(74) *Attorney, Agent, or Firm* — Posz Law Group, PLC

(57) ABSTRACT

An air-conditioning apparatus comprises an indoor unit including an indoor-side heat exchanger and an outdoor unit including a compressor, an outdoor-side heat exchanger and a flow switching device configured to switch a flow of refrigerant from the compressor to the indoor-side heat exchanger or the outdoor-side heat exchanger according to which of the heating operation and the defrosting operation is performed, the outdoor unit including a bypass connected to a heat transfer tube arranged at a lowermost stage of the outdoor-side heat exchanger and supplies the refrigerant from the compressor, and a drain pan arranged below the outdoor-side heat exchanger, the drain pan extending in a direction in which fins of the outdoor-side heat exchanger are stacked, and including a drain path inclined downward from one end to the other end in a longitudinal direction, and left and right side wall portions interposing the drain path therebetween.

6 Claims, 5 Drawing Sheets

(56) References Cited

U.S. PATENT DOCUMENTS

| | | | | |
|---|---|---|---|---|
| 2014/0245766 | A1* | 9/2014 | Wakamoto | F25B 47/022<br>62/151 |
| 2016/0273795 | A1* | 9/2016 | Takenaka | F24F 11/30 |
| 2016/0273816 | A1* | 9/2016 | Horiuchi | F25B 47/025 |

FOREIGN PATENT DOCUMENTS

| | | | | |
|---|---|---|---|---|
| EP | 2 333 440 | A1 | | 6/2011 |
| JP | H06-094263 | A | | 4/1994 |
| JP | 2007-045326 | A | | 2/2007 |
| JP | 2007045326 | A | * | 2/2007 |
| JP | 2008-202889 | A | | 9/2008 |
| JP | 2009-079851 | A | | 4/2009 |
| JP | 2010-048526 | A | | 3/2010 |
| JP | 2013-108729 | A | | 6/2013 |
| JP | 2013108729 | A | * | 6/2013 |
| JP | 2015-090225 | A | | 5/2015 |
| JP | 2015090225 | A | * | 5/2015 |

OTHER PUBLICATIONS

International Search Report of the International Searching Authority dated Nov. 8, 2016 for the corresponding International application No. PCT/JP2016/074373 (and English translation).
Office Action dated Apr. 8, 2020 issued in corresponding CN patent application No. 201680088487.0 (and English translation).
Examination Report dated Sep. 25, 2020 issued in corresponding GB patent application No. 1820589.8.

* cited by examiner

AIR-CONDITIONING APPARATUS

CROSS REFERENCE TO RELATED APPLICATION

This application is a U.S. national stage application of PCT/JP2016/074373 filed on Aug. 22, 2016, the contents of which are incorporated herein by reference.

TECHNICAL FIELD

The present invention relates to an air-conditioning apparatus that is to be applied to, for example, a multi-air-conditioning apparatus for buildings.

BACKGROUND ART

Some conventional air-conditioning apparatuses perform a defrosting operation that melts the frost generated on a heat exchanger of an outdoor unit in a heating operation in the winter. In the air-conditioning apparatus performing such an operation, when the defrosting operation is performed in cold climate areas, melted-frost water may freeze up in a lower portion of the heat exchanger again while flowing toward the lower portion of the heat exchanger. The air-conditioning apparatus therefore includes a bypass in which high-temperature and high-pressure gas refrigerant flows into the lower portion of the heat exchanger to prevent formation of root ice.

In the air-conditioning apparatus performing the defrosting operation, a surface area of the heat exchanger of the outdoor unit is increased, to improve the efficiency of the defrosting operation (for example, see Patent Literature 1).

CITATION LIST

Patent Literature

Patent Literature 1: Japanese Unexamined Patent Application Publication No. 2008-202889

SUMMARY OF INVENTION

Technical Problem

An air-conditioning apparatus in which a heat exchanger having an increased surface area is arranged is generally not installed on a base portion of an outdoor unit. In such an outdoor unit, a fan is mounted above the outdoor unit or between the heat exchangers, a space for a machine room in which devices such as a compressor are installed is provided in a front lower portion of the outdoor unit, and therefore the heat exchanger is provided on the space.

The outdoor unit thus configured requires a support or table supporting the heat exchanger. The melted-frost water, rain water, or the other water generated in the defrosting operation may easily stagnate on the support or the table, resulting in poor drainage thereof. When an air-conditioning apparatus is operated at a temperature below the freezing point, the air-conditioning apparatus alternately performs the heating operation and the defrosting operation, so that the heat exchanger of the outdoor unit repeats heating and cooling. Consequently, the water around the heat exchanger freezes up and melts repeatedly, and is expanded, which may cause compression and breakage of the heat transfer tube of the heat exchanger, and the breakage may cause leakage of the gas refrigerant. The melted-frost water easily stagnates around the heat transfer tube at the lowermost stage in the heat exchanger, and therefore it is most likely that the gas refrigerant leaks from the lowermost stage in the heat exchanger. In addition, the heat exchanger is provided at an upper portion of the outdoor units, resulting that the melted-frost water generated in the defrosting operation drops from the heat exchanger to the base portion.

When the air-conditioning apparatus performs the heating operation in the environment of less than the freezing point, the outdoor unit functions as an evaporator and air flow is generated by a fan, resulting that the base portion and parts such as a panel, made of a metal plate, are cooled to the temperature equivalent to the outdoor air temperature. When being stuck to the cooled base portion and panel in the defrosting operation, the melted-frost water freezes up instantaneously or after start of the heating operation. The defrosting operation is normally performed about one cycle per hour, and therefore a large amount of melted-frost water is generated in a high-humidity environment. When the melted-frost water freezes up on the base portion and the panel, detaching the panel in the space for maintenance may be impossible.

The present invention has been made to overcome the above-described problems, and an object of the present invention is to provide an air-conditioning apparatus capable of obtaining effective water drainage ability in a defrosting operation of an outdoor unit by preventing gas refrigerant from leaking due to freezing up of a heat exchanger while ensuring the serviceability of the maintenance.

Solution to Problem

An air-conditioning apparatus according to an embodiment of the present invention comprises an indoor unit including an indoor-side heat exchanger that functions as a condenser in a heating operation and functions as an evaporator in a defrosting operation; and an outdoor unit including a compressor that compresses and discharges refrigerant, an outdoor-side heat exchanger that functions as the evaporator in the heating operation and functions as the condenser in the defrosting operation, and a flow switching device configured to switch between flowing refrigerant from the compressor to the indoor-side heat exchanger or to the outdoor-side heat exchanger according to whether the heating operation is performed or the defrosting operation is performed, the outdoor unit including a bypass that is connected to a heat transfer tube arranged at a lowermost stage of the outdoor-side heat exchanger and supplies the refrigerant from the compressor, and a drain pan that is arranged below the outdoor-side heat exchanger with a gap therefrom, the drain pan extending in a direction in which fins of the outdoor-side heat exchanger are stacked, and includes a drain path that is inclined downward from one end to an other end in a longitudinal direction thereof, left and right side wall portions erected on both sides of the drain path, and inclined portions that are inclined downward toward the drain path from the side wall portions.

Advantageous Effects of Invention

According to an embodiment of the present invention, a drain pan is arranged below the outdoor-side heat exchanger with a gap therebetween, and the drain pan extends in a direction in which fins of the outdoor-side heat exchanger are stacked, and includes a drain path that is inclined downward from one end to the other end in a longitudinal direction, left and right side wall portions erected on both sides of the drain path, and inclined portions that are inclined downward toward the drain path from the side wall portions. This configuration can improve the water drainage ability of the outdoor-side heat exchangers, and prevent breakage caused by the freezing up of the heat transfer tubes of the outdoor-side heat exchangers, and the leakage of the gas refrigerant caused by such breakage. As a result, the freezing up of the water can be prevented, so that the front panel is opened to carry out the maintenance, thereby ensuring the serviceability.

DESCRIPTION OF EMBODIMENTS

An embodiment of an air-conditioning apparatus according to the present invention will now be described with reference to the drawings.

In the present embodiment, melted-frost water generated in a defrosting operation of, for example, a multi-air-conditioning apparatus for buildings is received by a drain pan arranged below an outdoor-side heat exchanger, and is drained in a centralized manner to ease the freezing up of melted-frost water around the heat exchanger and prevent gas refrigerant from leaking.

Figure 1:
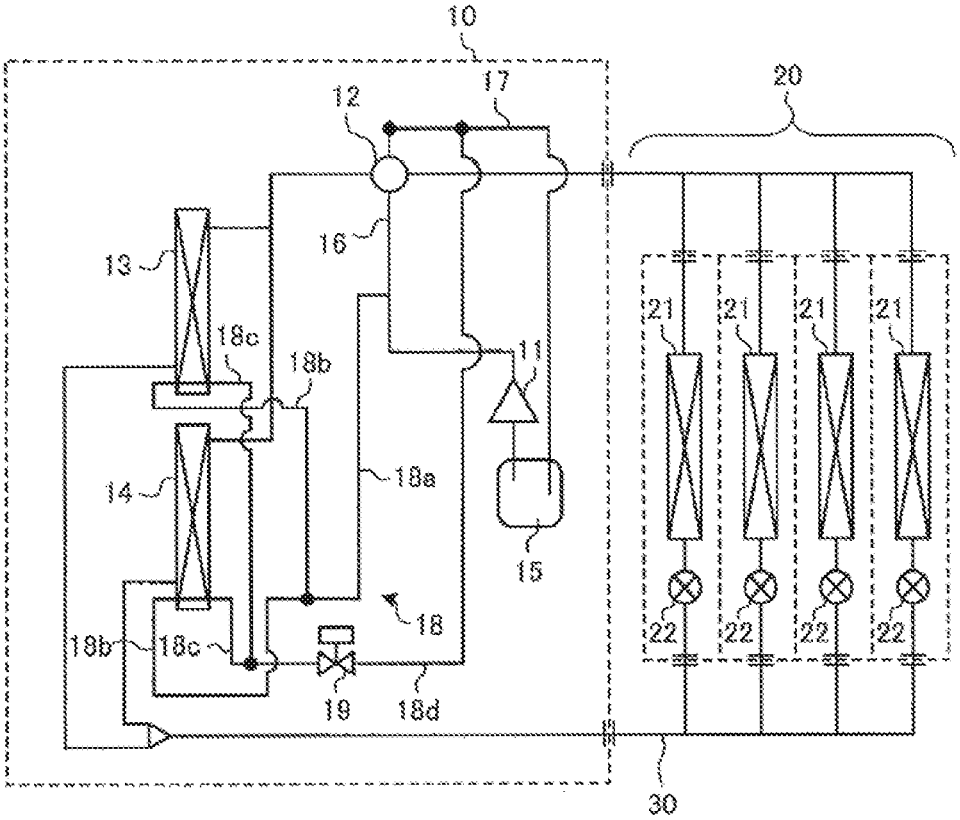
FIG. 1 is a refrigerant circuit diagram illustrating a schematic configuration of an exemplary air-conditioning apparatus according to an embodiment of the present invention.
Figure 2:
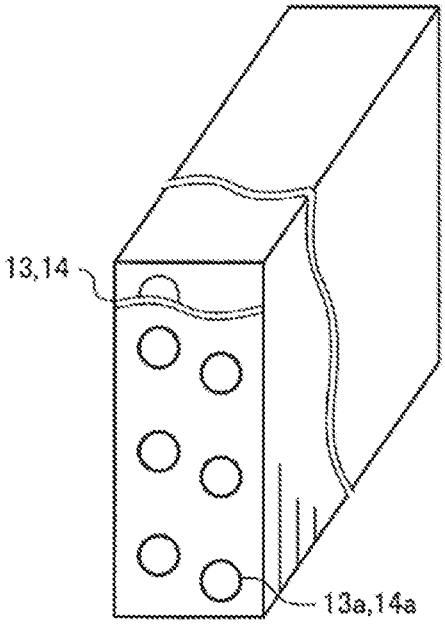
FIG. 2 is a perspective view illustrating a schematic configuration of an outdoor-side heat exchanger arranged in an outdoor unit in FIG. 1.

FIG. 1 is a refrigerant circuit diagram illustrating a schematic configuration of an example of air-conditioning apparatus according to the embodiment of the present invention. FIG. 2 is a perspective view illustrating a schematic configuration of an outdoor-side heat exchanger arranged in an outdoor unit in FIG. 1. Note that FIG. 1 illustrates an example in which four indoor units 20 are connected to an outdoor unit 10, but the number of indoor units 20 is not limited to four.

As illustrated in FIG. 1, the air-conditioning apparatus according to the present embodiment includes the outdoor unit 10, a plurality of indoor units 20, and a refrigerant pipe 30 connecting the outdoor unit 10 and the indoor units 20. In this air-conditioning apparatus, the four indoor units 20 are connected in parallel to the outdoor unit 10.

Outdoor Unit

The outdoor unit 10 includes a compressor 11, a refrigerant flow switching device 12 such as a four-way valve, outdoor-side heat exchangers 13, 14, an accumulator 15, and an outdoor-side fan (not illustrated) configured to supply air to each of the outdoor-side heat exchangers 13, 14. The compressor 11 is composed of, for example, an inverter compressor whose capacity can be controlled, and is configured to suck low-temperature and low-pressure gas refrigerant, and compress the gas refrigerant to discharge the high-temperature and high-pressure gas refrigerant. The refrigerant flow switching device 12 is configured to switch between flowing refrigerant in a flow path for a heating operation mode and flowing refrigerant in flow path for a cooling operation mode or a defrosting operation mode.

The outdoor-side heat exchangers 13, 14 are formed in, for example, an L-shape. Corner portions of the respective outdoor-side heat exchangers 13, 14 are diagonally arranged so that the heat exchanger is formed in a quadrilateral shape. In this case, the outdoor-side fan is arranged above the outdoor-side heat exchangers 13, 14. A machine room in which the compressor 11, the flow switching device 12, the accumulator 15, and the other devices are installed is arranged below the outdoor-side heat exchangers 13, 14. Furthermore, a front panel is provided in the machine room, the front panel being opened and closed for the maintenance.

Each of the outdoor-side heat exchangers 13, 14 functions as an evaporator in the heating operation mode, and functions as a condenser in the cooling operation mode or the defrosting operation mode. Each of the outdoor-side heat exchangers 13, 14 is configured to exchange heat between air supplied by the outdoor-side fan and the refrigerant. The accumulator 15 is arranged on the suction side of the compressor 11, and is configured to store excess refrigerant resulting from the difference between the heating operation mode and the cooling operation mode, or excess refrigerant generated due to transient changes in operation.

Figure 5:
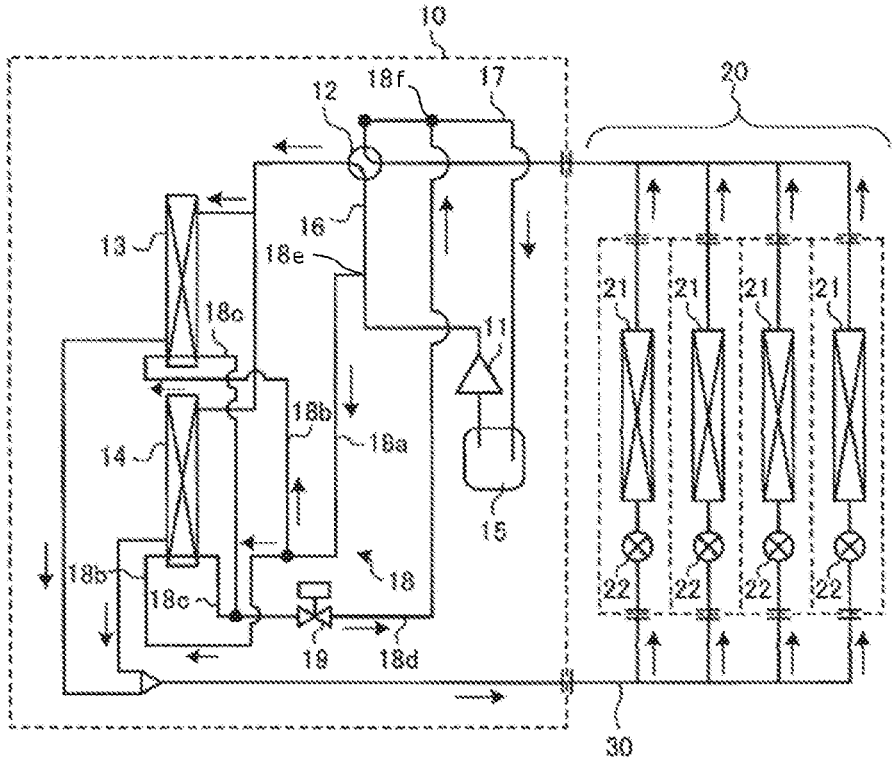
FIG. 5 is a refrigerant circuit diagram when refrigerant flows in a bypass in the defrosting operation mode of the air-conditioning apparatus of FIG. 4.

A bypass 18 is arranged in the above-described outdoor unit 10. The bypass 18 includes a first bypass pipe 18*a* that branches off from a refrigerant pipe 16 between the compressor 11 and the flow switching device 12, a second bypass 18*b* that branches off from the first bypass pipe 18*a* and is connected to each of one ends of the heat transfer tubes 13*a*, 14*a* of the respective outdoor-side heat exchangers 13, 14, a third bypass pipe 18*c* that is connected to each of the other ends of the heat transfer tubes 13*a*, 14*a* and is merged, a fourth bypass pipe 18*d* that branches off from a refrigerant pipe 17 between the flow switching device 12 and the accumulator 15, and is connected with a junction point of the third bypass pipe 18*c*, and a valve opening and closing device 19 that is attached to the fourth bypass pipe 18*d*. The bypass 18 has a first end 18*e* and a second end 18*f*, as shown in FIG. 5. The valve opening and closing device 19 is composed of, for example, solenoid valve. The above-described heat transfer tubes 13*a*, 14*a* each are a heat transfer tube arranged at the lowermost stage among a plurality of heat transfer tubes, as illustrated in FIG. 2. Note that the bypass 18 may be connected to any positions as long as a pressure differential can be generated.

Indoor Unit

The indoor unit 20 includes four indoor-side heat exchangers 21, four expansion devices 22 that are connected in series to the respective indoor-side heat exchangers 21, an indoor-side fan (not illustrated) that supplies air to each of the indoor-side heat exchangers 21, and the other devices, Each of the indoor-side heat exchangers 21, which functions as a condenser in the heating operation mode, and functions as an evaporator in the cooling operation mode, is configured to exchange heat between air supplied by the indoor-side fan and the refrigerant and supply cooling air or heating air to an air-conditioning target space. The expansion devices 22, which each function as a pressure reducing valve or an expansion valve, are configured to cause the refrigerant to be depressurized and expanded. The expansion devices 22 each are composed of an electronic expansion valve whose opening degree can be controlled, or the other device.

Next, operations performed by the air-conditioning apparatus according to the present embodiment will be described.

Heating Operation Mode

Figure 3:
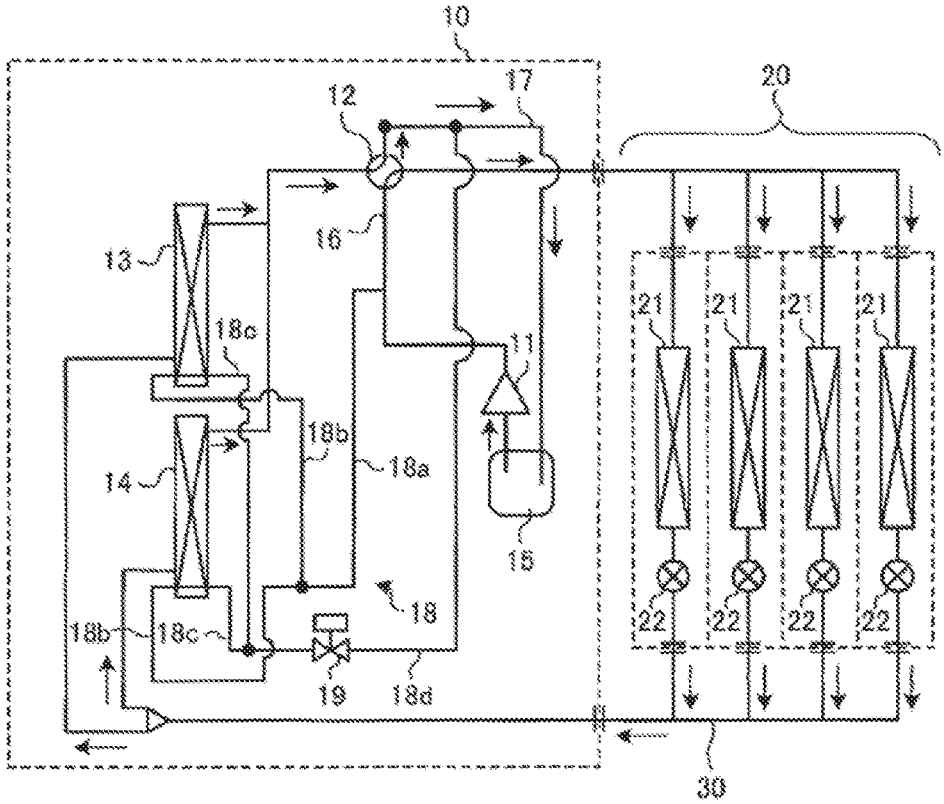
FIG. 3 is a refrigerant circuit diagram illustrating a flow of refrigerant in a heating operation mode of the air-conditioning apparatus according to the embodiment of the present invention.

FIG. 3 is a refrigerant circuit diagram illustrating the flow of refrigerant in the heating operation mode of the air-conditioning apparatus according to the embodiment of the present invention. FIG. 3 illustrates a case where all of the indoor units 20 are driven, and arrows indicated in FIG. 3 each indicate the flow direction of the refrigerant.

When the compressor 11 is driven, the low-temperature and low-pressure gas refrigerant flows into the compressor 11, is compressed by the compressor 11, and is discharged as the high-temperature and high-pressure gas refrigerant. The high-temperature and high-pressure gas refrigerant having been discharged from the compressor 11 flows out of the outdoor unit 10 through the flow switching device 12, and flows into each of the indoor-side heat exchangers 21 through the refrigerant pipe 30. The high-temperature and high-pressure gas refrigerant having flowed into each of the indoor-side heat exchangers 21 exchanges heat with the air supplied from the indoor-side fan to reject heat to ambient air and condense, thereby turning into the low-temperature and high-pressure liquid refrigerant, and then flows out of the indoor-side heat exchangers 21. The low-temperature and high-pressure liquid refrigerant having flowed out of the indoor-side heat exchangers 21 is expanded and depressurized by the respective expansion devices 22, thereby turning into the low-temperature and low-pressure two-phase gas-liquid refrigerant, and then flows out of the indoor unit 20.

The two-phase gas-liquid refrigerant having flowed out of the indoor unit 20 flows into the outdoor-side heat exchangers 13, 14 of the outdoor unit 10 through the refrigerant pipe 30. The two-phase gas-liquid refrigerant having flowed into the outdoor-side heat exchangers 13, 14 exchanges heat with the air supplied from the outdoor-side fan to receive heat from the ambient air and evaporate, thereby turning into the low-pressure gas refrigerant, and then flows out of the outdoor-side heat exchangers 13, 14. The gas refrigerant flows into the accumulator 5 through the flow switching device 2. The gas refrigerant having flowed into the accumulator 5 is separated into the liquid refrigerant and the gas refrigerant, so that the low-temperature and low-pressure gas refrigerant is sucked into the compressor 11 again. The sucked gas refrigerant is compressed by the compressor 11 and is discharged again, so that the refrigerant is repeatedly circulated.

Where the heating operation is continuously performed when the outdoor air has a low-temperature (an evaporating temperature is 0 degrees C. or lower), frost is formed on each of surfaces of the outdoor-side heat exchangers 13, 14. Moisture contained in the air with which heat is to be exchanged is condensed on each of the surfaces of the outdoor-side heat exchangers 13, 14 each receiving heat as an evaporator, resulting in frost being formed on each of the surfaces of the outdoor-side heat exchangers 13, 14. When the amount of frost is increased, the thermal resistance is increased and the volume of air is decreased. Thus, the temperature (evaporating temperature) of each of the heat transfer tubes of the outdoor-side heat exchangers 13, 14 is reduced, and consequently the heating capacity cannot be sufficiently exerted. To sufficiently exert the heating capacity, the frost needs to be removed by the defrosting operation.

Defrosting Operation Mode

Figure 4:
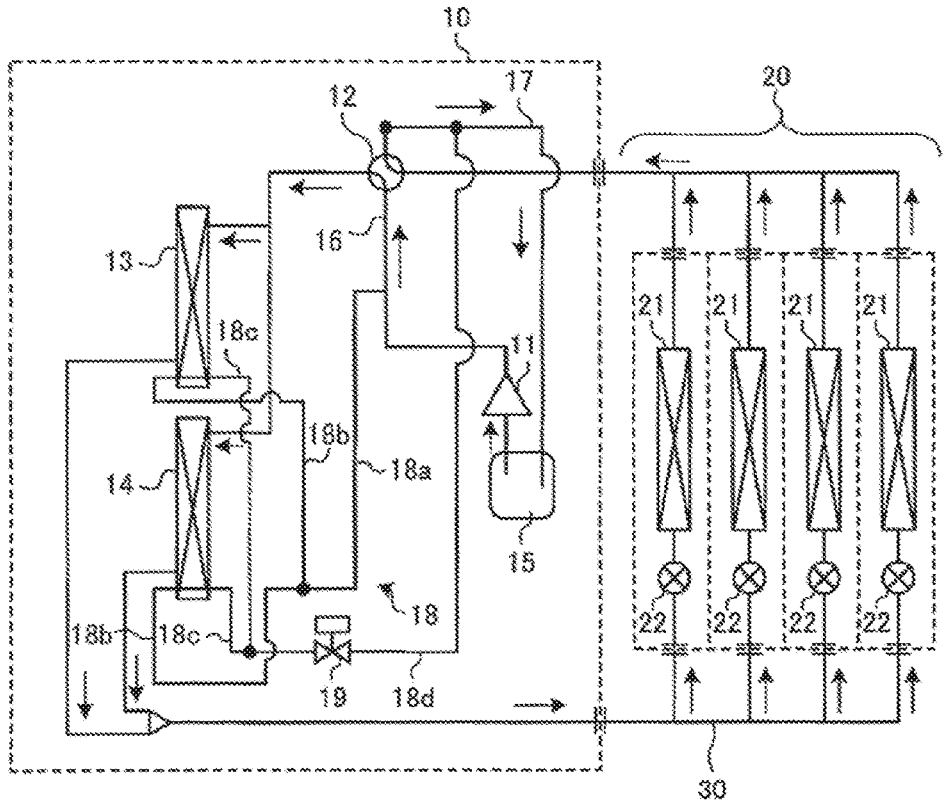
FIG. 4 is a refrigerant circuit diagram illustrating a flow of refrigerant in a defrosting operation mode of the air-conditioning apparatus according to the embodiment of the present invention.

FIG. 4 is a refrigerant circuit diagram illustrating a flow of refrigerant in a defrosting operation mode of the air-conditioning apparatus according to the embodiment of the present invention. Note that FIG. 4 illustrates a case where all of the indoor units are driven, and arrows indicated in FIG. 4 each indicate the flow direction of the refrigerant.

In the defrosting operation, the normal heating operation is interrupted, and the flow switching device 2 is used so that the refrigerant circulates in the same direction as that in the cooling operation. In this case, the low-temperature and low-pressure gas refrigerant flows into the compressor 11, is compressed by the compressor 11, and is discharged as the high-temperature and high-pressure gas refrigerant. The high-temperature and high-pressure gas refrigerant having been discharged from the compressor 11 flows into the outdoor-side heat exchangers 13, 14 through the flow switching device 12.

The high-temperature and high-pressure gas refrigerant having flowed into the outdoor-side heat exchangers 13, 14 exchanges heat with the air supplied from the outdoor-side fan to reject heat to ambient air, thereby turning into the low-temperature and high-pressure liquid refrigerant. This rejection of heat enables the frost stuck to the outdoor-side heat exchangers 13, 14 to be melted. In this case, the outdoor-side fan is often stopped. The low-temperature and high-pressure liquid refrigerant having flowed out of the outdoor-side heat exchangers 13, 14 flows into the indoor unit 20 through the refrigerant pipe 30. The low-temperature and high-pressure liquid refrigerant having flowed into the indoor unit 20 is expanded and depressurized by the expansion devices 22, thereby turning into the low-temperature and low-pressure two-phase gas-liquid refrigerant. The two-phase gas-liquid refrigerant flows into the indoor-side heat exchangers 21, and flows into the outdoor unit 10 in a two-phase gas-liquid state again without exchanging heat, and then flows into the accumulator 5 through the flow switching device 2, The refrigerant having flowed into the accumulator 5 is separated into the liquid refrigerant and the gas refrigerant, so that the low-temperature and low-pressure gas refrigerant is sucked into the compressor 11 again. The sucked gas refrigerant is compressed by the compressor 11 and is discharged again, so that the circulation of refrigerant is repeated.

Next, the operation of the bypass 18 will be described.

FIG. 5 is a refrigerant circuit diagram in the case where the refrigerant flows in the bypass in the defrosting operation mode of the air-conditioning apparatus of FIG. 4.

When the valve opening and closing device 19 is opened, the high-temperature and high-pressure gas refrigerant flows into the bypass. The valve opening and closing device 19 is opened at the timing, for example, when the temperature of a temperature detection unit provided at each of the heat transfer tubes of the outdoor-side heat exchangers 13, 14 reaches T1 degrees C. to thereby finish the defrosting operation, or when the temperature of the temperature detection unit reaches T2 degrees C. lower than T1 degrees C. by a constant temperature (T1>T2).

When the valve opening and closing device 19 is open, the high-pressure and high-temperature gas refrigerant flows into the bypass 18, and then flows into the heat transfer tubes 13*a*, 14*a* arranged at the lowermost stages of the respective the outdoor-side heat exchangers 13, 14, resulting that the lowermost portions of the outdoor-side heat exchangers 13, 14 can be heated. Thus, the melted-frost water stagnating on the outdoor-side heat exchangers 13, 14 can be prevented from freezing up again (forming root ice).

The melted-frost water, rain water, or the other water in the defrosting operation flows downward by gravity through the fins of the outdoor-side heat exchanger. At this time, when the outdoor-side heat exchanger is placed higher than a base portion of the outdoor unit or is placed on a table so that a drain hole is not provided at a position directly under the outdoor-side heat exchanger or within a close range of the outdoor-side heat exchanger, the length of a drain path is increased, resulting in the melted-frost water, rain water, or the other water easily freezing up before it is discharged outside the outdoor unit from the drain hole. Two patterns are considered for freezing up of the melted-frost water in the outdoor unit. In a portion where a support portion of the outdoor-side heat exchanger contacts the outdoor-side heat exchanger, the melted-frost water stagnates on the ground plane of the support portion of the outdoor-side heat exchanger, resulting in freezing up due to outdoor air temperature below the freezing point. At this time, in the heating operation, the outdoor-side heat exchanger functions as an evaporator, and the melted-frost water is cooled to a temperature equal to or lower than the outdoor air temperature, resulting in freezing up of the stagnating water. In the defrosting operation, the outdoor-side heat exchanger functions as a condenser, and the melted-frost water is heated to a temperature equal to or higher than the outdoor air temperature, resulting in melting of the frozen melted-frost water. When this freezing and melting is repeated, the melted-frost water around the heat transfer tube adjacent to the support portion of the heat exchanger is repeatedly expanded, which may cause breakage of the heat transfer tube.

The defrosting operation is normally performed about one cycle per hour, and therefore a large amount of melted-frost water is generated in a high-humidity environment. When the melted-frost water flows on the base portion and the panel of the outdoor unit from the outdoor-side heat exchanger, and freezes up, the generated ice grows in the outdoor unit, which may prevent the front panel in the machine room positioned below the outdoor-side heat exchanger from being detached, and may make it impossible to carry out the maintenance.

In the present embodiment, the drain pan is provided to prevent the melted-frost water from stagnating on the lower portions of the outdoor-side heat exchangers 13, 14 and prevent a water droplet from dropping on the base portion of the outdoor unit 10.

Figure 6:
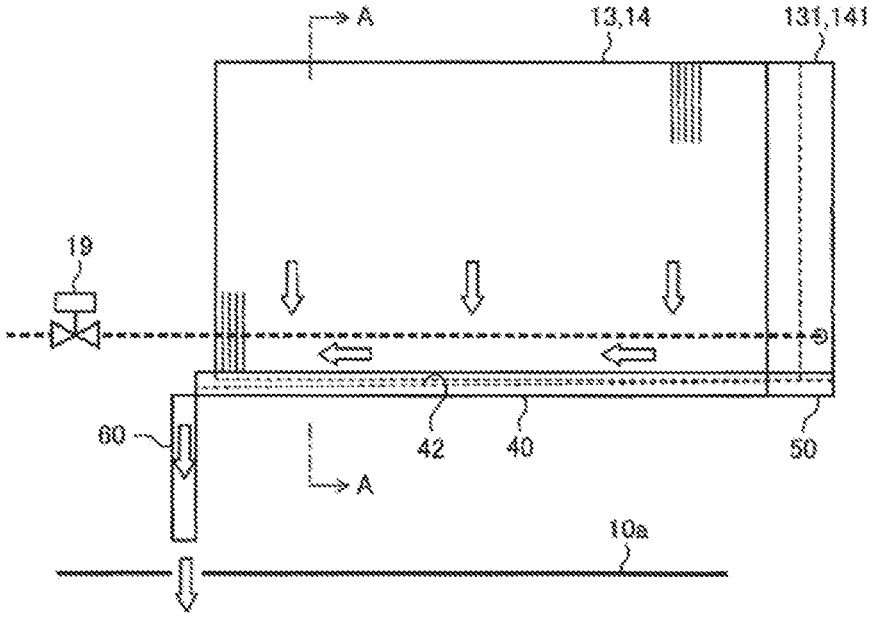
FIG. 6 is a side view of an outdoor-side heat exchanger and a drain pan of the air-conditioning apparatus according to the embodiment of the present invention.
Figure 7:
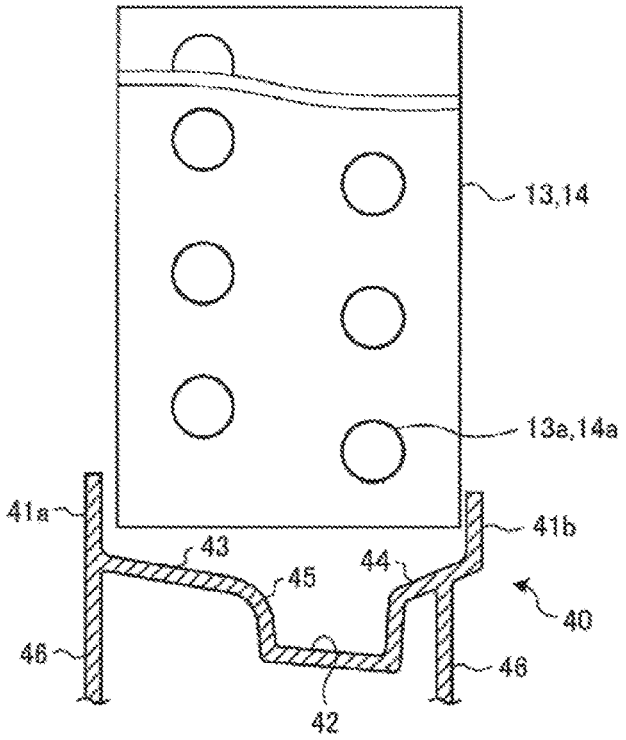
FIG. 7 is a cross-sectional view illustrating the outdoor-side heat exchanger and the drain pan when viewed in a direction of arrows A-A of FIG. 6.
Figure 8:
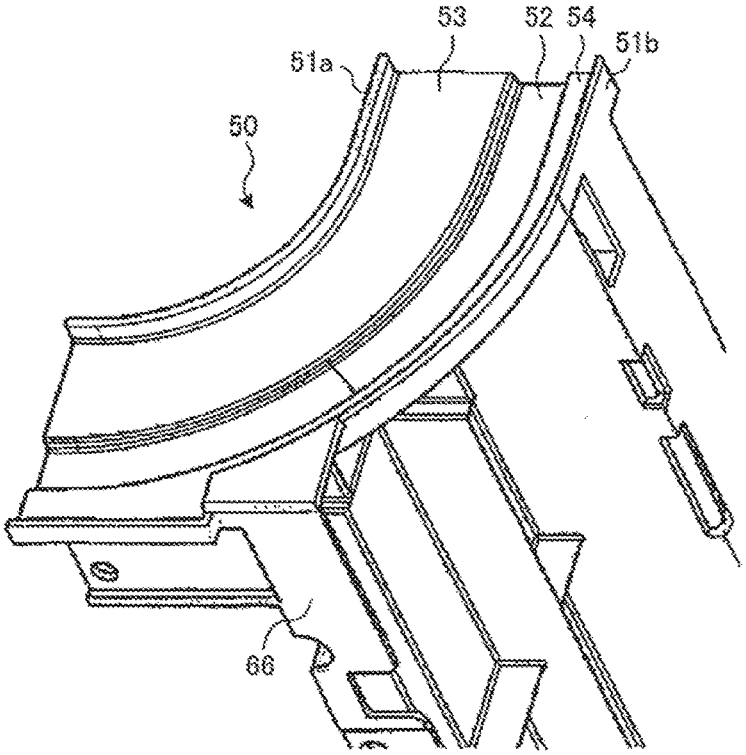
FIG. 8 is a perspective view illustrating a corner drain pan of the drain pan of FIG. 7.
Figure 9:
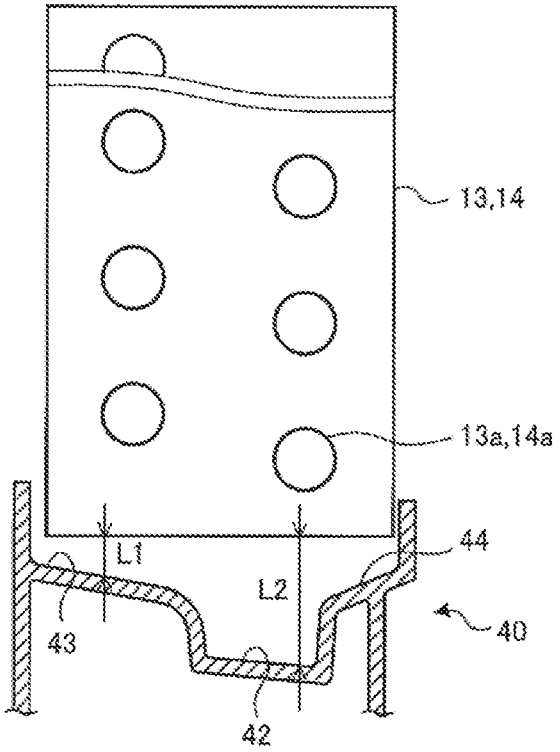
FIG. 9 is a cross-sectional view illustrating a positional relationship between the outdoor-side heat exchanger and the drain pan in FIG. 7.

FIG. 6 is a side view of an outdoor-side heat exchanger and a drain pan of the air-conditioning apparatus according to the embodiment of the present invention. FIG. 7 is a cross-sectional view illustrating the outdoor-side heat exchanger and the drain pan when viewed in a direction of arrows A-A of FIG. 6. FIG. 8 is a perspective view illustrating a corner drain pan of the drain pan of FIG. 7. FIG. 9 is a cross-sectional view illustrating a positional relationship between the outdoor-side heat exchanger and the drain pan in FIG. 7.

As illustrated in FIG. 6, the drain pan in the present embodiment extends in a direction in which the fins of the outdoor-side heat exchanger 13, 14 are stacked. As illustrated in FIG. 7, this drain pan 40 has an opened top to be formed in a groove shape, and is installed above a base portion 10*a* of the outdoor unit 10 by legs 46 that are integrally formed with the top surface. A drain path 42 is provided at a position between left and right side wall portions 41*a*, 41*b* of the drain pan 40 and displaced toward one side of the left and right side wall portions 41*a*, 41*b*.

The drain path 42 is inclined downward from one end toward the other end in a longitudinal direction thereof. In other words, the drain path 42 is inclined downward from a corner drain pan 50 side toward a drain side. The drain path 42 is inclined toward one side, the one side being in that in a transparent view of the drain pan 40, the transparent view being viewed in the longitudinal direction of the drain path 40. This is to ensure that the melted-frost water, rain water, or the other water having flowed into the drain path 42 collects and flows on the one side. That is, this prevents the water from being spread onto the drain path 42 and freezing up in the drain path 42. The other end of the drain pan 40 is provided with a drain pipe 60 for discharging the melted-frost water, rain water, or the other water flowing from the drain path 42 to the outside of the outdoor unit 10. The drain path 42 has a volume enough to store the melted-frost water generated when the assumed maximum amount of frost is melted. The width of the drain path 42 is determined based on an amount of heat rejection obtained from the temperature of the bypass 18 and the outdoor air temperature.

An inclined portion 43 that is inclined downward toward the drain path 42 from the side wall portion 41*a* is provided in the drain pan 40. A corner portion 45 of the inclined portion 43 is rounded. The round corner portion 45 is provided to reduce portions on which the melted-frost water stagnates. In addition, an inclined portion 44 that is inclined downward toward the drain path 42 from the other side wall portion 41*b* is provided in the drain pan 40. Providing these inclined portions 43, 44 enables the melted-frost water dropped from the outdoor-side heat exchanger 13, 14 to flow into the drain path 42, thereby preventing the melted-frost water from stagnating.

As illustrated in FIG. 7, the drain pan 40 is arranged so that the side wall portions 41*a*, 41*b* of the drain pan 40 are erected to face bottom edge portions of both longitudinal sides of the outdoor-side heat exchanger 13, 14 with a gap from the outdoor-side heat exchanger with the upper edge portions of the side wall portions 41*a*, 41 being positioned below the heat transfer tube 13*a*, 14*a* that serves as the bypass 18 and that is provided for the outdoor-side heat exchanger 13, 14.

As illustrated in FIG. 9, the outdoor-side heat exchanger 13, 14 is arranged so that the bottom edge portion of the outdoor-side heat exchanger 13, 14 is positioned above the inclined portion 43 of the drain pan 40 by 11 mm or more, and above the drain path 42 by 90 mm or less. A distance between the bottom edge portion of the outdoor-side heat exchanger 13, 14 and the drain pan 40 is set to 11 mm or more to prevent the melted-frost water from stagnating between the bottom edge portion of the outdoor-side heat exchanger 13, 14 and the drain pan 40 due to the surface tension of the melted-frost water when the bottom edge portion of the outdoor-side heat exchanger 13, 14 is too close to the drain pan 40. Since an amount of radiation heat cannot be obtained from the outdoor-side heat exchanger 13, 14 when the bottom edge portion of the outdoor-side heat exchanger 13, 14 is too distant from the drain path 42, a distance of 90 mm or less is secured therebetween.

The above-described drain pan 40 is connected to the both ends of the corner drain pan 50 illustrated in FIG. 8, and the corner drain pans 50 are diagonally arranged to form a quadrilateral shape. As described above, this is because the outdoor-side heat exchangers 13, 14 have corner portions 131, 141, respectively, to be formed in an L-shape. Each of the both ends of the corner drain pan 50 is mounted and connected with one end of each drain pan 40.

Similar to the drain pan 40, the corner drain pan 50 includes left and right side wall portions 51*a*, 51*b*, a corner drain path 52 communicating with the drain path 42 of the drain pan 40, and corner inclined portions 53, 54 having the same shapes as those of the inclined portions 43, 44 of the drain pan 40. As described above, the other end of each drain pan 40 is provided with the drain pipe 60 for discharging water from the drain path 42. Note that the width of the corner drain path 52 is determined based on an amount of heat rejection obtained from the temperature of the bypass 18 and the outdoor air temperature, in the same manner as the drain path 42.

The corner portions 131, 141 of the respective outdoor-side heat exchangers 13, 14 are mounted on the corner drain pans 50. In other words, a fin corner portion at a lower edge portion of the corner portion 131, 141 of the outdoor-side heat exchanger 13, 14 is mounted on the corner inclined portions 53, 54 of the corner drain pan 50. In this case, the area of a portion where the outdoor-side heat exchanger 13, 14 is in contact with the corner drain pan 50 is minimum, and the corner inclined portions 53, 54 of the corner drain pan 50 prevent the melted-frost water from stagnating so that the melted-frost water flows into the corner drain path 52 from a gap between the fins. Note that the above-described outdoor-side heat exchangers 13, 14 are attached to and supported by a frame of the outdoor unit 10. The corner drain pan 50 is supported by a leg 66, as illustrated in FIG. 8.

Using the drain pans 40 and the corner drain pans 50 that are configured as described above enables the melted-frost water generated in the defrosting operation, rain water, or the other water to be discharged without stagnating around the lower portions of the outdoor-side heat exchangers 13, 14. This can improve the water drainage ability of the outdoor-side heat exchangers 13, 14, and prevent breakage caused by the freezing up of the heat transfer tubes of the outdoor-side heat exchangers 13, 14, and the leakage of the gas refrigerant caused by such breakage. As a result, the freezing up of the water can be prevented, so that the freezing up and locking of front panel is avoided to ensure that the maintenance is carried out, thereby ensuring the serviceability.

REFERENCE SIGNS LIST

1 outdoor unit 11 compressor 12 flow switching device 13, 14 outdoor-side heat exchanger 13*a*, 14*a* heat transfer tube 15 accumulator

16, 17 refrigerant pipe 18 bypass 18*a* first bypass pipe 18*b* second bypass pipe 18*c* third bypass pipe 18*d* fourth bypass pipe 19 valve opening and closing device 20 indoor unit 21 indoor-side heat exchanger 22 expansion device 30 refrigerant pipe 40 drain pan 41*a*, 41*b* side wall portion 42 drain path 43, 44 inclined portion 45 corner portion 46 leg

50 corner drain pan 51*a*, 51*b* corner side wall portion 52 corner drain path 53, 54 corner inclined portion 66 leg

The invention claimed is:

1. An air-conditioning apparatus, comprising:

an indoor unit including an indoor-side heat exchanger that functions as a condenser in a heating operation and functions as an evaporator in a defrosting operation; and an outdoor unit including a compressor that compresses and discharges refrigerant, an outdoor-side heat exchanger that functions as the evaporator in the heating operation and functions as the condenser in the defrosting operation, and a flow switching device configured to switch between flowing refrigerant from the compressor to the indoor-side heat exchanger or to the outdoor-side heat exchanger according to whether the heating operation is performed or the defrosting operation is performed, wherein the outdoor unit includes a bypass that is connected to a heat transfer tube arranged at a lowermost stage of the outdoor-side heat exchanger and supplies the refrigerant from the compressor, which is high-temperature and high-pressure refrigerant, and a drain pan that is arranged below and spaced apart from the outdoor-side heat exchanger so that a gap is formed between the drain pan and the outdoor-side heat exchanger, a first end of the bypass supplies the high-temperature and high-pressure refrigerant from the compressor, a second end of the bypass is connected to a refrigerant pipe that is between the compressor and the flow switching device, and low-temperature and low-pressure refrigerant that is drawn into the compressor flows in the refrigerant pipe that is connected to the second end of the bypass, the drain pan extends in a direction in which fins of the outdoor-side heat exchanger are stacked and includes a drain path that is inclined downward from one end to another end in a longitudinal direction thereof, left and right side wall portions erected on both sides of the drain path, and inclined portions that are inclined downward toward the drain path from the side wall portions.

2. The air-conditioning apparatus of claim 1, wherein the drain pan is arranged so that the side wall portions of the drain pan are erected to face bottom edge portions of both longitudinal sides of the outdoor-side heat exchanger so that a gap is formed between each of the side wall portions and the outdoor-side heat exchanger, and the upper edge portions of the side wall portions are positioned below the heat transfer tube.

3. The air-conditioning apparatus of claim 1, wherein the outdoor-side heat exchanger is formed in an L-shape having a corner portion, a corner drain pan is provided on which a corner portion of the outdoor-side heat exchanger is mounted, each of opposite end portions of the corner drain pan is connected with the drain pan, and the corner drain pan includes a corner drain path communicating with the drain path of the drain pan and a corner inclined portion having the same shape as those of the inclined portions of the drain pan.

4. The air-conditioning apparatus of claim 1, wherein the drain path is inclined toward one side in the longitudinal direction of the drain path.

5. The air-conditioning apparatus of claim 1, wherein the outdoor-side heat exchanger is arranged so that the bottom edge portion of the outdoor-side heat exchanger is positioned above the inclined portion of the drain pan by 11 mm or more.

6. The air-conditioning apparatus of claim 1, wherein the outdoor-side heat exchanger is arranged so that the bottom edge portion of the outdoor-side heat exchanger is positioned above the drain path by 90 mm or less.

* * * * *